United States Patent [19]

Morris et al.

[11] Patent Number: 4,577,586

[45] Date of Patent: Mar. 25, 1986

[54] AUTOMATIC SKI WAXING MACHINE

[76] Inventors: Fredric H. Morris; Alvan M. Morris, both of 7148 Loch Lomond Dr., Bethesda, Md. 20817

[21] Appl. No.: 729,715

[22] Filed: May 2, 1985

[51] Int. Cl.[4] ..... B05C 1/02; B05C 11/02

[52] U.S. Cl. ..... 118/63; 118/72; 118/75; 118/100; 118/110; 118/73; 118/202

[58] Field of Search ..... 118/72, 202, 75, 73, 118/63, 110, 100, 66, 244

[56] References Cited

U.S. PATENT DOCUMENTS

| | | | |
|---|---|---|---|
| 2,537,511 | 1/1951 | Coulombe | 118/72 X |
| 3,045,639 | 7/1962 | Kurlander et al. | 118/72 X |
| 3,425,394 | 2/1969 | Rey | 118/72 X |
| 3,464,381 | 9/1969 | Rey | 118/202 |

*Primary Examiner*—John P. McIntosh

*Attorney, Agent, or Firm*—Pollock, Vande Sande and Priddy

[57] ABSTRACT

An automatic ski waxing apparatus includes a conveyor arrangement upon which a person wearing skis may stand for transport past a plurality of processing stations. One such station removes old wax from the skis by use of a mechanical scraper followed by an applicator of liquid wax remover, followed by a drier. Another such station downstream of the first-mentioned station applies a thin film of molten wax to the under surface of the skis, then directs cold air jets on the skis to set the wax, thereafter scrapes excess wax from the bottom of the skis, and then buffs the residual wax to a polished finish. The processing stations may also include a station for sharpening the edges of the skis as a person wearing the skis is transported along the processing path.

16 Claims, 9 Drawing Figures

SKI
SKI

AUTOMATIC SKI WAXING MACHINE

BACKGROUND OF THE INVENTION

It is well known that the running surfaces of snow skis must be provided with a layer of wax whose characteristics are appropriately adapted to the prevailing conditions of snow and ice, and to the intended use of the skis, e.g., climbing, racing, jumping and slalom. Accordingly, it is customary to wax snow skis before a day of skiing, and sometimes during a day of skiing, particularly if prevailing conditions change during the day. At the present time, the waxing of snow skis, as well as the sharpening of the edges of such skis, is ordinarily effected by leaving the skis with a ski shop attendant who cleans the skis and thereafter applies a new layer of hot wax to the undersurface of the skis. After the new wax layer has been hardened, the attendant shaves and buffs the wax surface. Before these waxing steps occur, the attendant may also sharpen the edges of the skis, a procedure which is necessary when skiing is to occur on an icy surface, in order to facilitate turning. This entire process is costly and time consuming, i.e., after skis have been left with an attendant for the purposes described, it is often necessary to wait a day or more for the return of the skis.

The present invention provides an apparatus which simplifies the sharpening and waxing of snow skis before and during a day of skiing, and eliminates the need to leave skis at a ski shop with the resultant loss of skiing time. The invention also overcomes problems which arise when differing snow conditions are encountered, e.g., changing conditions from one location to another, from one day to another, or often during a single day when snow may change from powder to ice to slush. The invention allows a skier to quickly have the wax changed on the skis in accordance with prevailing conditions at any time the skier wishes such a change to be effected, and without the skier having to remove the skis for purposes of rewaxing or sharpening.

SUMMARY OF THE INVENTION

An automatic ski waxing apparatus constructed in accordance with the present invention comprises a conveyor upon which a person wearing skis may stand and be transported along an elongated processing path. The conveyor includes motor driven rollers which engage the undersurface of the skis, a motor driven pusher which engages the rear of the skier's boots, and motor driven hand rails which are disposed along each side of the processing path and which are adapted to be grasped by a skier as he or she is transported along the processing path. The conveyor also includes guide means which engage the opposing sides of each ski, e.g., spring biased rollers, for setting the positions of the skis during their transport along the processing path to inhibit lateral movement thereof and to help assure that the skis will be properly positioned for various automated processing operations that are to occur during the transport of the skier passed various processing stations that are disposed adjacent the conveyor.

The processing stations include a station for initially cleaning accumulated mud, snow or the like from the skis. A subsequent station, for removing old wax from the skis, comprises a mechanical scraper which is spring biased to engage the under surface of the skis as they move along the conveyor, followed by an applicator of liquid wax remover taking the form of a roller which rotates in a bath of such wax remover, followed by a drying stage which may comprise one or more air jets and one or more rollers of soft fabric material.

A next subsequent processing stage includes means for sharpening the skis, comprising a motor driven bottom sharpener element and motor driven edge sharpening elements. These elements, normally idle, can be activated by switches that are engaged by skis which are approaching the sharpening stage. In the alternative, such switches can be used to enable the sharpening stage for operation with actual operation then being under the control of a further manually operable switch that can be controlled by the skier at a location immediately upstream of the sharpening station, in dependence upon whether or not the skier wishes the skis to be resharpened.

A further processing station, downstream of the sharpening station (if such a sharpening station is provided), applies new wax to the under surface of the skis. This further station comprises a heated trough that is located below a portion of the conveyor means and contains molten wax, and an applicator preferably taking the form of a roller which is located in said trough and which engages the undersurface of the skis as they pass the wax applicator, for applying a thin film of new wax to the under surface of the skis. A further drying stage, preferably taking the form of one or more cold air jets, is located downstream of the molten wax trough for setting the wax that has been applied to the skis to a hardened state. Thereafter, as the skis continue to be transported along the processing path, scrapers remove excess wax from the bottom of the skis, and the skis then pass over a motor driven buffing roller which smooths and polishes the wax. The skier continues beyond this stage to the end of the processing path where the conveyor moves him or her onto a snow surface to continue or commence a skiing run.

One or more apparatuses of the type described can be located at various places in a ski resort. Each such apparatus can be coin operated or, in the alternative, can be supervised and operated under the control of an attendant. Each such apparatus has the capability of handling a large number of skiers in a relatively short period of time, which makes the apparatus cost effective, reduces the cost of both waxing and sharpening skis, and minimizes the loss of valuable ski time for such waxing and sharpening operations.

BRIEF DESCRIPTION OF THE DRAWINGS

The foregoing objects, advantages, construction and operation of the present invention will become more readily apparent from the following description and accompanying drawings wherein:

FIG. 2, consisting of FIGS. 2*a* and 2*b* interconnected to one another, is a side view of the apparatus shown in FIG. 1, also shown schematically and with some components omitted for purposes of clarity;

DESCRIPTION OF THE PREFERRED EMBODIMENTS

Figure 1A:
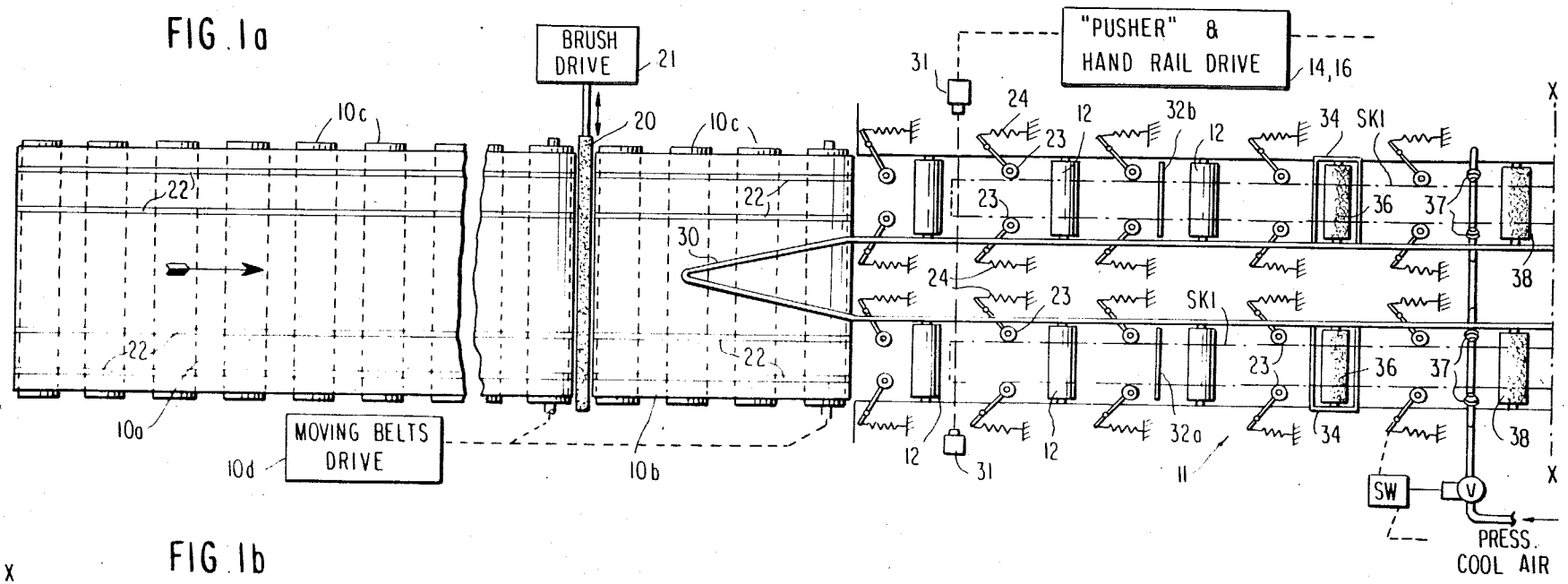
FIG. 1, consisting of FIGS. 1*a* and 1*b* interconnected to one another at line x—x therebetween, is a top plan view of the apparatus of the present invention, shown schematically and with some components omitted for purposes of clarity.
Figure 1B:
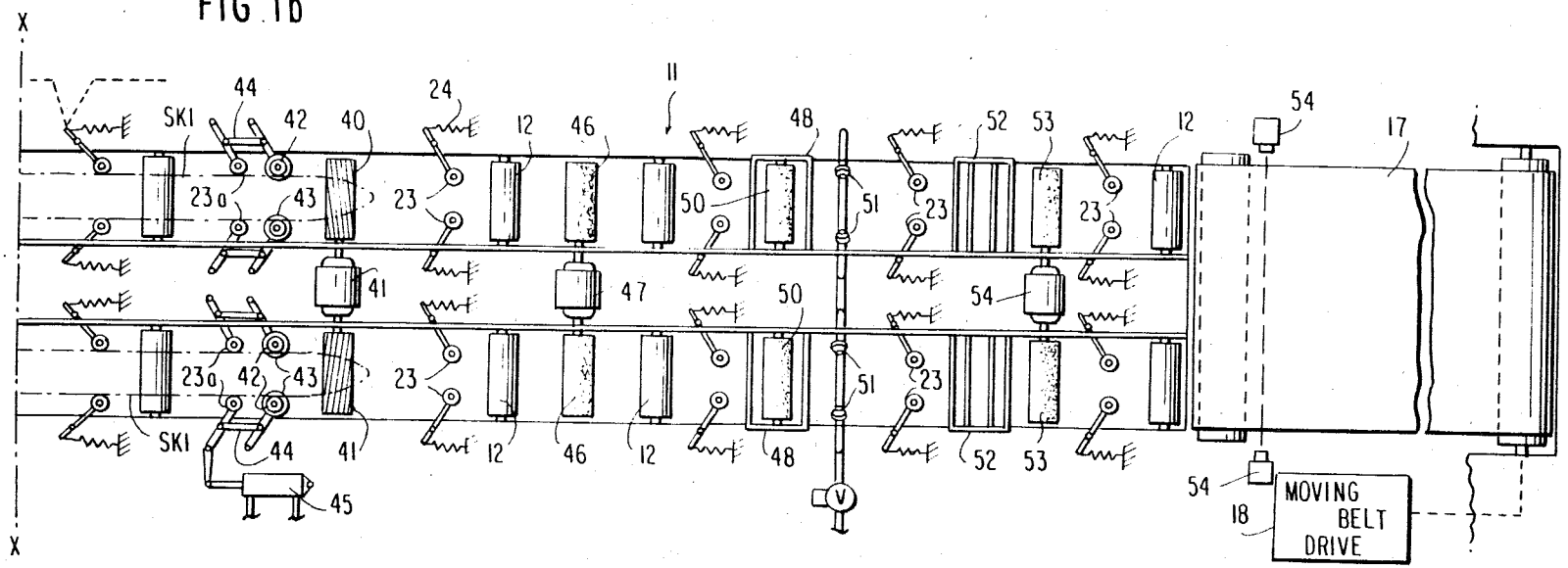
Figures 2A, 2B, 5, 6, 7:
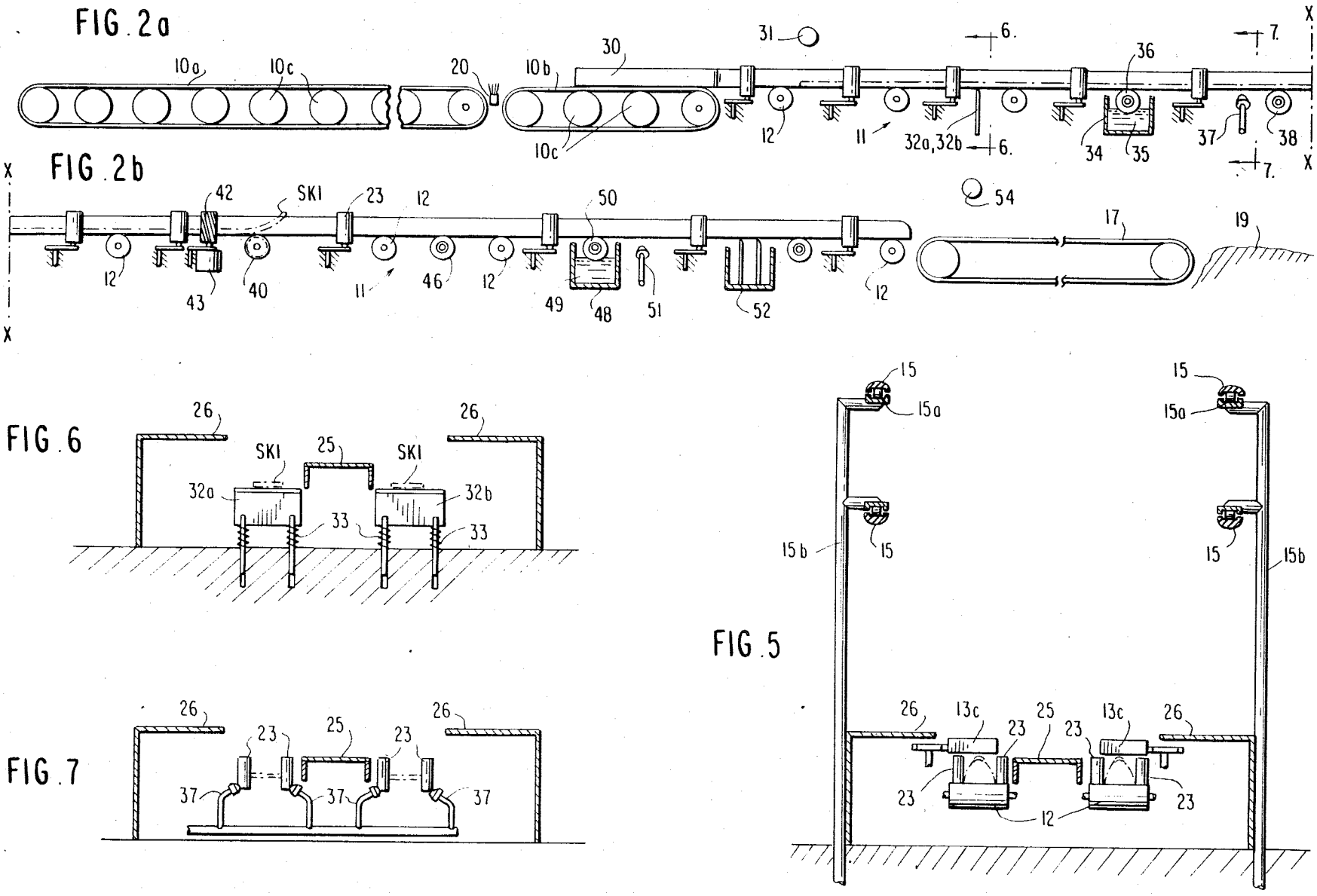
FIG. 5 is a schematic transverse section of the apparatus taken along line 5—5 of FIG. 4.
FIGS. 6 and 7 are schematic transverse sections taken along lines 6—6 and 7—7 of FIG. 2*a*.
Figure 3:
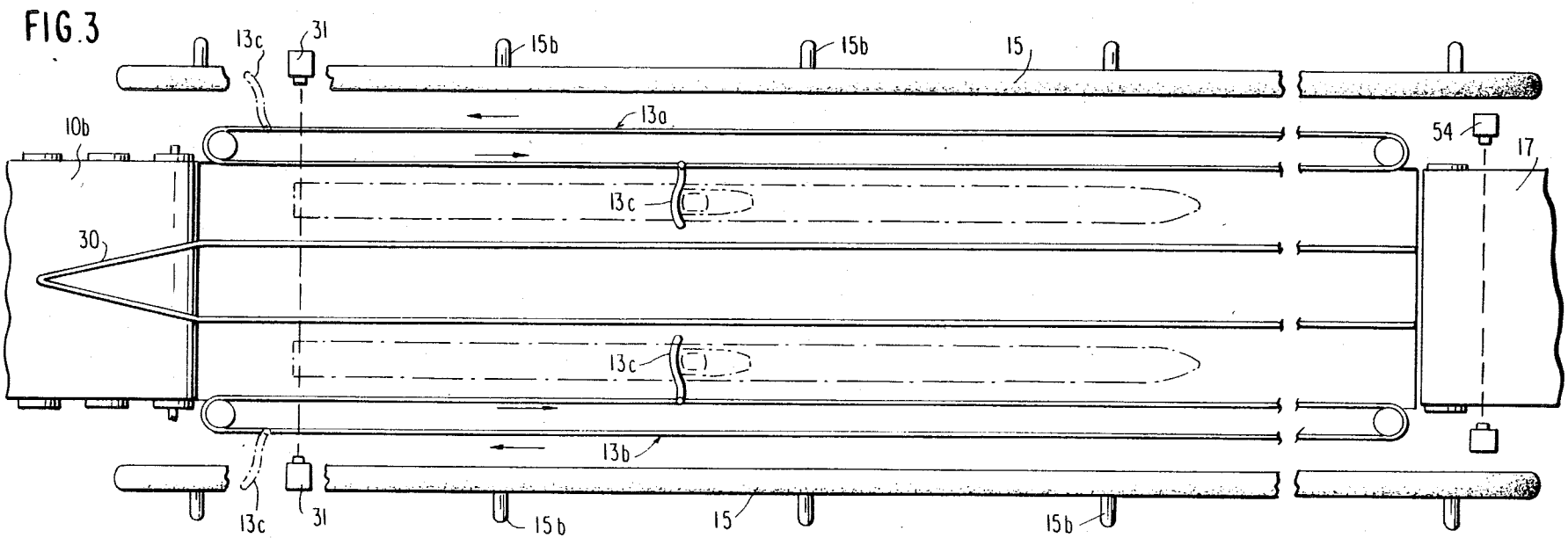
FIG. 3 is a fragmentary top view of the apparatus showing components that have been omitted from FIGS. 1 and 2, i.e., a pusher drive adapted to engage the skier's boots, and a moving hand rail adapted to be grasped by a skier being transported along the processing path.
Figure 4:
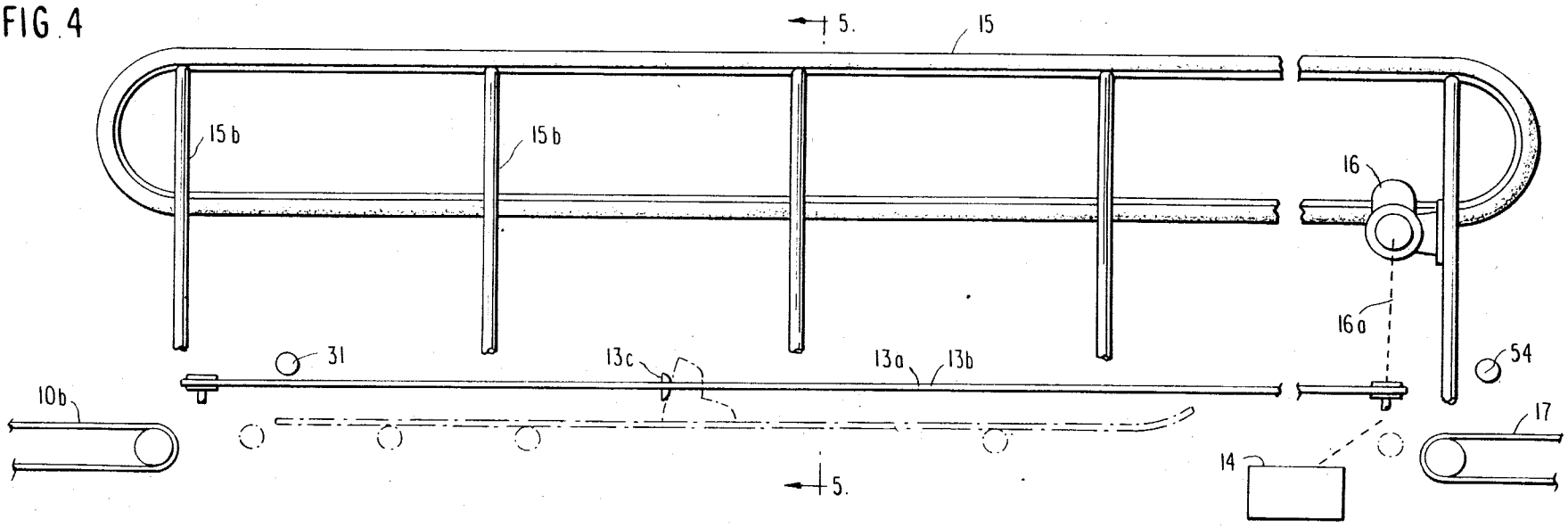
FIG. 4 is a side view of FIG. 3.

Referring now to the several figures, like numerals of which refer to like parts throughout, it will be seen that the automatic ski waxing apparatus of the present invention comprises a conveyor arrangement for transporting a person wearing skis along an elongated processing path past a plurality of processing stations that are located along that path. The conveyor arrangement includes a plurality of sections which are disposed in alignment with one another, i.e., a pair of moving belts 10*a* and 10*b* mounted on rollers 10*c* and driven by a motor drive 10*d*, a central section 11 consisting of a plurality of rubber surfaced rollers 12 spaced approximately eight inches apart and interconnected to one another by a chain and driven by a drive motor (not shown) to support the skis and skiers and transport them in a forward motion, a pair of chains 13*a*, 13*b* (see FIG. 3) located along the opposing edges of central section 11, the chains 13*a*, 13*b* being driven by a drive 14 (FIG. 4) and having spring biased boot pushers 13*c* thereon adapted to engage the back of a skier's boots to help propel the skier along the central section 11, and a pair of movable hand rails 15 located on opposing sides of central section 11, supported on rails 15*a* (FIG. 5) and mounted on stanchions 15*b*, the hand rails 15 being driven by a further drive 16 which is synchronized, as at 16*a*, with boot drive 14. The conveyor arrangement further includes an additional moving belt 17 at the downstream end of the central section 11, the belt 17 being driven by a motor drive 18 and being operative to transport a skier leaving central section 11 onto an adjacent snow surface generally designated 19 in FIG. 2*b*.

The moving belts 10*a*, 10*b*, comprising the approach conveyor portion of the system, are separated from one another by an elongated rotary brush 20 that is driven by a motor 21, the brush 20 being operative to clean mud, snow, etc., from the skis of a skier standing on belts 10*a*, 10*b* as the skier is transported past brush 20. The belt drive 10*d* and brush drive 21 are, in a preferred embodiment of the invention, normally deenergized, and are activated by insertion of a proper amount of currency into an associated control unit, or by a supervising attendant, when the apparatus is to be used by a skier. The belts 10*a*, 10*b* preferably include, moreover, brightly colored strips 22 thereon to assist a skier in placing his skis in alignment with a pair of channels, one for each ski, located in a central section 11 of the conveyor arrangement. The said channels are defined by a plurality of vertical guide rollers 23 which are urged toward the center of each channel by springs 24 or by an equivalent air pressure system, a central cover plate 25, and edge plates 26 that extend inwardly from stanchions 15*b* (see FIGS. 5–7). These latter portions of the structure inhibit lateral movement of the skis as the skier is transported along the central section 11 of the conveyor arrangement past a plurality of processing stations which function to remove old wax from the skis, sharpen the edges of the skis if needed, and apply new wax to the undersurface of each ski.

After a skier moves onto belt 10*a*, places his skis between the color strips 22, and activates motor drives 10*d* and 21, the skier is moved by belts 10*a*, 10*b* toward the processing central section 11 of the conveyor arrangement. A triangular guide member 30, integral with central cover 25, is provided to assure that the skis, if misaligned, become forcibly separated from one another as they enter the central section 11. Each ski then passes between successive pairs of vertical guide rollers 23, and onto the support rollers 12 of the central section. As the nose of each ski passes the first such guide rollers 12, their presence is detected by a photocell arrangement 31 which causes the pusher and hand rail drives 14, 16 to be energized. Energization of the pusher drive 14 causes chains 13*a*, 13*b* to move in the directions shown by arrows in FIG. 3 to bring a padded boot pusher into engagement with the rear of each of the skiers boots and to push the boots in a forward direction. Activation of hand rail drive 16 causes the hand rails 15, which are being grasped on either side of the central section by the hands of a skier standing on the conveyor, to begin moving in a forward direction. The action of driven support rollers 12, spring biased boot pushers 13*c*, and moving hand rail 15 cooperate with one another to transport the skier in a forward direction, and to move the skis on central section 11 past the several processing stations that are located adjacent that section.

The first such processing section which is encountered operates to remove old wax from the skis. It consists of a pair of scraper plates 32*a*, 32*b*, one for each ski, which are spring biased as at 33 (see FIG. 6) upwardly into contact with the under surface of each ski. The skis then pass over a small pan 34 containing a liquid wax remover 35 and a soft roller 36 which is rotated by movement of the skis through the liquid 35 to apply the liquid wax remover to the under surface of each ski so as to remove residual wax. The skis then pass over a plurality of air nozzles 37 directed toward the under surface of the skis to dry the wax remover therefrom, and thereafter pass over soft rollers 38 which complete the drying process.

The next processing station, downstream of the wax removal station, is used to sharpen the edges of the skis. Since a skier may not wish to resharpen his ski edges each time the skis are rewaxed, the sharpening operation if preferably made optional and under the control of the skier moving along the conveyor arrangement. More particularly, a control lever is preferably disposed closely adjacent to one of the hand rails 15 in association with a sign containing instructions for manipulation of that lever to permit the skier to include or eliminate, as desired, the sharpening procedure. The sharpeners include bottom grinding rollers 40 which are driven by a motor 41, and generally vertical grinders or filing wheels 42 driven by associated motors 43. The vertical filing rollers 42 are coupled via a parallelogram linkage 44 to adjacent vertical guide rollers 23*a*, and are further coupled to a pneumatic control cylinder 45. These elements in cooperation with one another adjust and align the revolving cylindrical filing rollers 42 so that they contact the edge of each ski at precisely the correct angle and pressure when the sharpening station is rendered operative. The skis, after leaving this portion of the sharpening station, pass over a pair of rollers 46 that are driven by a motor 47 and function to remove any filing scraps that remain on the skis.

The skis are now moved forward to a further station which applies new wax to the skis. This further station consists of a pair of waxing troughs 48, each of which is heated, e.g., by an electric heater, and each of which contains a supply of melted wax 49 and a rotatable roller 50 for applying a thin film of the wax 49 to the under surface of each ski. The particular wax present in the troughs 48 is selected, and changed as needed by an operator, in conformity with the then prevailing skiing conditions, e.g., ice, granular, powder, slush, etc. After a thin film of the molten wax in trough 48 has been applied by rollers 50 to the skis, the skis pass over a series of air jets 51 that set the wax to a hardened state. The skis then proceed along their respective channels to mechanical scrapers 52 which scrape excess wax from the bottom of the skis, and then pass over cork buffing wheels 53 which are rotated at comparatively high speed by a motor 54 to smooth the newly-applied wax and buff it to a polished condition.

As the skis leave the waxing station, their presence is detected by a further photocell control mechanism 54 which activates moving belt drive 18 at the downstream end of the processing path to move the skier onto an adjacent snow surface. After this is done, energization of moving belt drives 10*d* and 18, and of pusher and hand rail drives 14, 16, are terminated, and the boot pushers 13*c* fold back onto their associated chain drives 13*a*, 13*b* until the entire mechanism is again activated by a further skier.

While we have thus described preferred embodiments of the present invention, many variations will be apparent to those skilled in the art. For example, equipment similar to that described herein could be used to wax water skis or surf boards. It must therefore be understood that the foregoing description is intended to be illustrative only and not limitative of the present invention, and all such variations and modifications as are in accord with the principles described are meant to fall within the scope of the appended claims.

Having thus described our invention, we claim:

1. An automatic ski waxing apparatus comprising conveyor means for transporting a person wearing skis along an elongated processing path, said conveyor means including guide means for locating said skis at predetermined positions relative to one another and relative to said conveyor means as said person is transported along said path, and a plurality of processing stations disposed along said path adjacent said positioned skis, said stations including first means for removing old wax from the under surface of said positioned skis, and second means downstream of said first means for applying new wax to the under surface of said positioned skis.

2. The apparatus of claim 1 wherein said first means comprises mechanical scraper means, and means for urging said scraper means into engagement with the under surface of said skis as said skis are transported along said path by said conveyor means.

3. The apparatus of claim 2 wherein said second means comprises a trough located below a portion of said conveyor means and containing molten wax, and an applicator for applying a thin film of said molten wax from said trough to the under surface of each of said positioned skis as said skis are transported by said conveyor means past said trough.

4. The apparatus of claim 3 wherein said second means also includes drier means downstream of said trough for solidifying molten wax that adheres to said skis to a hardened state.

5. The apparatus of claim 4 wherein said drier means comprises at least one air nozzle.

6. The apparatus of claim 4 including means downstream of said drier means for buffing the solidified wax on said skis to a polished state.

7. The apparatus of claim 1 wherein said first means comprises applicator means for applying a liquid wax remover to said skis, and means located downstream of said applicator means for drying said skis.

8. The apparatus of claim 1 wherein the person wearing skis stands on said conveyor means, said conveyor means comprising motor driven elements in engagement with said skis for transporting the person along said path.

9. The apparatus of claim 1 wherein the person wearing skis stands on a portion of said conveyor means, said conveyor means having a further portion comprising motor driven members located along the sides of said path for movement along said path, said driven members being adapted to be grasped by the hands of the person standing on said conveyor means.

10. The apparatus of claim 9 wherein said conveyor means comprises further motor driven members in engagement with said skis for transporting the person wearing skis past said processing stations.

11. The apparatus of claim 1 wherein said guide means comprise elements which are in engagement with the opposing elongated edges of each of said skis, said elements moving along said path with said conveyor means.

12. The apparatus of claim 11 wherein said elements are rollers, and means for urging said rollers into resilient engagement with the elongated edges of said skis.

13. The apparatus of claim 1 wherein said processing stations include means disposed adjacent said path for sharpening the edges of said skis.

14. The apparatus of claim 13 including means operable by the person wearing skis as said person is transported along said path for controlling the operation of said sharpening means.

15. The apparatus of claim 1 wherein a person wearing skis and ski boots stands on said conveyor means, said conveyor means including motor driven means engaging the ski boots of said person and movable along said path for transporting the person wearing skis past said processing stations.

16. The apparatus of claim 1 including means disposed adjacent said conveyor station upstream of said first means for cleaning said skis prior to the removal of old wax therefrom.

* * * * *